United States Patent [19]

Cuba, Jr. et al.

[11] Patent Number: 4,940,258

[45] Date of Patent: Jul. 10, 1990

[54] DISPLAY STICKER FOR A VEHICULAR WINDOW

[75] Inventors: Ronald R. Cuba, Jr., Wichita, Kans.; Roland Jenkins, Holly, Mich.

[73] Assignee: Uarco Incorporated, Barrington, Ill.

[21] Appl. No.: 293,978

[22] Filed: Jan. 6, 1989

[51] Int. Cl.[5] ..... B42D 15/00

[52] U.S. Cl. ..... 283/81; 283/101; 283/108; 283/100; 283/98

[58] Field of Search ..... 283/81, 101, 94, 98, 283/99, 100, 103, 105, 106, 108; 156/249, 289; 40/594, 593, 643, 644

[56] References Cited

U.S. PATENT DOCUMENTS

| | | | |
|---|---|---|---|
| 3,950,580 | 4/1976 | Boudet | 156/249 |
| 4,060,166 | 11/1977 | Romagnoli | 206/216 |
| 4,110,502 | 8/1978 | Baer | 283/81 |
| 4,270,291 | 6/1981 | Babberl | 40/594 |
| 4,305,216 | 12/1981 | Skelton | 40/644 |
| 4,306,367 | 12/1981 | Otto | 283/81 |

*Primary Examiner*—Frank T. Yost
*Assistant Examiner*—Thomas Hamill, Jr.
*Attorney, Agent, or Firm*—Wood, Phillips, Mason, Recktenwald & VanSanten

[57] ABSTRACT

Removal of a window display sticker without partial or entire mutilation or distortion is facilitated in a business form display including a first sheet 30 of label stock having one side 32 coated with pressure sensitive adhesive 34, a second sheet 36 of release liner material having a size and shape corresponding to the first sheet 30 and with a coated surface 38 removably adhered to the adhesive 34 and an opposed surface 42 for receiving variable information to be displayed. Cuts 58, 60, 62, 64 in the sheet 36 near at least two opposed edges 50, 52, 54, 56 are provided so that parts of the sheet 36 between the opposed edges 50, 52, 54, 56 may be removed from adhesion to the first sheet 30 to expose adhesive 34 at at least two opposed edges 50, 52, 54, 56 in flanking relation to the surface 42 and any variable information that may be received thereon.

7 Claims, 3 Drawing Sheets

DISPLAY STICKER FOR A VEHICULAR WINDOW

FIELD OF THE INVENTION

This invention relates to business forms, and more specifically, to business forms that may be utilized for display purposes as, for example, displaying variable information through a transparent object.

BACKGROUND OF THE INVENTION

There are many occasions in the commercial world for displaying information through transparent objects, most notably windows. The types of display may range from posters advertising the sale of various items at grocery stores to equipment and price listings on the so-called "stickers" employed in the sale of new cars and the like.

The case of the latter presents an interesting situation in that, with a high degree of frequency, the purchaser of a new vehicle would prefer to retain the sticker as a record of both the standard and optional equipment on the vehicle and perhaps for other reasons as well. Commonly, however, the variable information is printed on a paper form which is then adhered as by moistenable adhesive to the interior of a window of the vehicle. After purchase of the vehicle, the sticker is removed, frequently by the automobile dealer who will typically not be particularly concerned about the preservation of the sticker. In removing the sticker, razor blades may be used and they tend to mutilate the sticker so that it can no longer serve as a record of the items stated thereon. Alternatively or additively, the stickers are soaked with water. If the soaking is thorough, the sticker may be removed intact but because of the soaking, the sticker will warp and wrinkle and not present a good appearance as a preservable record.

And if the moistening is not sufficient or nonuniform, the sticker may rip during the removal process, again hindering its ability to serve as a good record of the matters stated thereon.

The present invention is directed to overcoming one or more of the above problems.

SUMMARY OF THE INVENTION

It is the principal object of the invention to provide a new and improved business form that may be utilized for the display of variable information through a transparent object. It is also an object of the invention to provide a new and improved method of displaying variable information through a transparent object. Both the method and the business form are intended to provide a convenient means of displaying variable information and yet one wherein the display media may be readily and easily removed from the display position without partial or entire mutilation, destruction, deformation, etc.

According to one aspect of the invention, there is provided a business form for use as a removable window sticker wherein a variable information receiving section may be adhered to a window and then easily removed therefrom without carrying residual adhesive and without being partially or wholly destroyed, mutilated, etc. The business form includes a first sheet of label stock or the like having one side coated with pressure sensitive adhesive. A second sheet of release liner material having a size and shape corresponding to the first sheet is provided and includes a coated surface removably adhered to the adhesive of the first sheet and an opposed surface remote from the adhesive for receiving variable information to be displayed through a window or the like. Cuts are located in the second sheet near at least two opposed edges thereof so that parts of the second sheet between the opposed edges and the cuts may be removed from adhesion to the first sheet to expose adhesive at the two opposed edges in flanking relation to the opposed surface and variable information thereon. As a consequence, the form may be adhered to a window or the like by the exposed adhesive, and, when removed therefrom, the remainder of the second sheet may be pealed from the first sheet free of residual adhesive to serve as an undamaged record of the matters recorded thereon.

In a preferred embodiment, the cuts are opposed parts of a peripheral cut in the second sheet. The peripheral cut and the edges of the second sheet define a removable, peripheral frame.

In a highly preferred embodiment, the frame is a continuous, one-piece frame so that the entire frame may be removed in a single removable step.

The invention also contemplates that there be provided an exposed grasping tab on one or the other of the sheets.

In a highly preferred embodiment, there are a plurality of the business forms in end-to-end abutment and they are delineated from one another by lines of weakening to thereby define a continuous business form.

In the case of a continuous business form made according to the invention, the label stock is in the form of a first elongated web while the release liner is in the form of a second elongated web having a width on the same order as the first elongated web.

Preferably, the second web of each form length includes a slit extending from one marginal edge to an adjacent marginal edge across at least one of the removable sections to define a removal tab to facilitate removal of the one section.

The marginal edges can be defined by the lines of weakening. They may also be defined by the longitudinal edges of the webs or they may be defined by both.

According to another aspect of the invention, there is provided a method of displaying variable information through a transparent object using a pressure sensitive label having label stock coated on one side with pressure sensitive adhesive and a release liner removably adhered to the adhesive. The method comprises the steps of (a) inscribing the variable information to be displayed on the side of the release liner remote from the adhesive, (b) removing a part of the release liner not bearing variable information to be displayed from the label stock to expose adhesive on the label stock in adjacency to the remote side, and (c) fixing the label to a transparent object by placing the remote side against the transparent object and applying pressure to the label stock oppositely of the exposed adhesive and in the direction of the transparent object to cause the exposed adhesive to adhere to the transparent object.

In a highly preferred embodiment, step (b) comprises the step of removing parts of the release liner at opposed marginal edges of the label. In an even more preferred embodiment of the invention, step (b) is performed by removing a closed peripheral frame of the release liner which defines the removal part.

The invention further contemplates that steps (a), (b) and (c) be performed in that sequence.

A highly preferred embodiment of the invention includes the further steps of (d) removing the label from the transparent object after display is complete by breaking the adhesion between the exposed adhesive and the transparent object, (e) peeling the remainder of the release liner from the label stock, and (f) saving the remainder of the release liner as a record for future reference.

In a highly preferred embodiment, the transparent object is a vehicular window.

Other objects and advantages will become apparent from the following specification taken in connection with the accompanying drawings.

DESCRIPTION OF THE PREFERRED EMBODIMENTS

Figure 1:
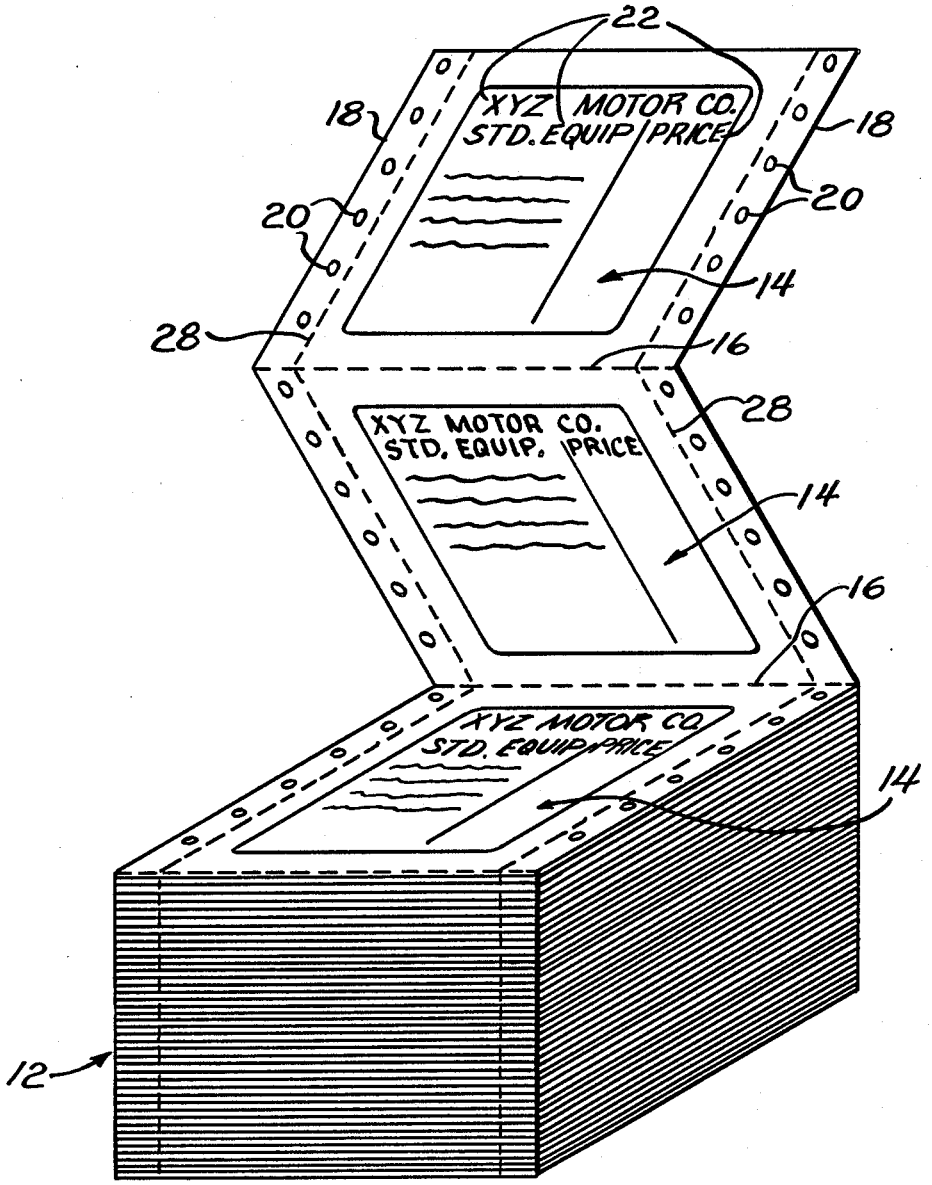
FIG. 1 is a perspective view of a continuous business form made according to the invention.

An exemplary embodiment of a business form made according to the invention is illustrated in the drawings. With reference to FIG. 1, it is illustrated in continuous form and includes a zigzag folded stack 12 of individual form lengths generally designated 14 delineated from one another by cross lines of weakening 16. In the usual case, the cross lines of weakening 16 will be defined by lines of perforation.

When in continuous form as illustrated, frequently, both longitudinal margins 18 of the form will be provided with line holes 20 which may be utilized for feeding the form both through manufacturing equipment as well as a computer printer or the like.

Typically, one side of each form length 14 will be preprinted during the manufacturing process with fixed information 22. In FIG. 1, the fixed information consists of the legends "XYZ Motor Co", "STD Equip", and "Price". In addition, each form length 14 includes one or more areas 24 and 26 for receipt of variable information that may be printed thereupon by any suitable printer, usually a computer printer. For example, the area 24 is illustrated as being under the legend "STD Equip" and if the business form is to be utilized in the sale of new vehicles, there might follow a listing of the standard equipment on the vehicle to which the form length 14 is to be attached. Similarly, under the legend "Price", price information may be inscribed in the area 26.

Needless to say, a large variety of other columns for receipt of variable information as well as legends constituting fixed information may be utilized. For example, there might be a column for optional equipment as well as areas that may be utilized to provide information in compliance with government regulation as, for example, EPA mileage estimates.

In the usual case, where the business form is a continuous business form as illustrated in FIG. 1, after the variable information has been inscribed on each form length 14, the longitudinal margins of the form may be trimmed along the dotted lines 28 to remove the pin feed holes 20. Individual form lengths 14 may be severed from one another by conventional bursting along the lines of weakening 16.

Figure 2:
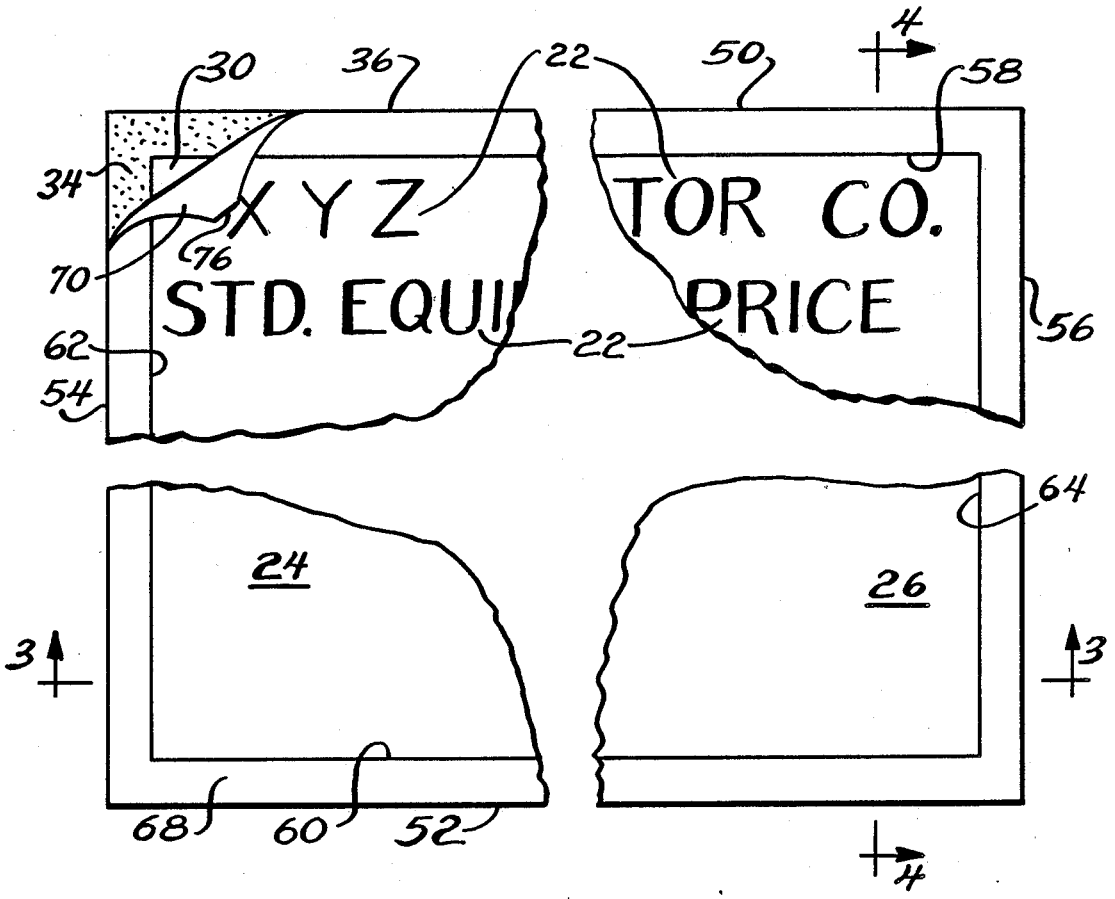
FIG. 2 is a fragmentary, enlarged plan view of one form length of a business form made according to the invention at an early stage in its processing for use.
Figure 3:
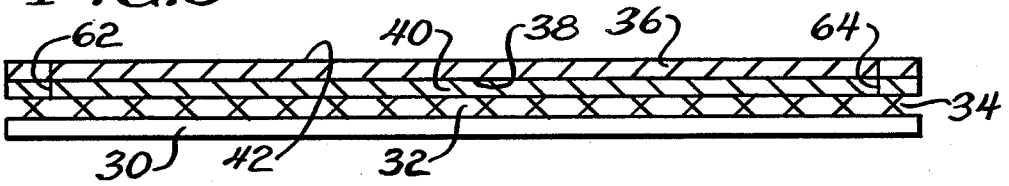
FIG. 3 is a sectional view taken approximately along the line 3—3 in FIG. 2.
Figure 4:
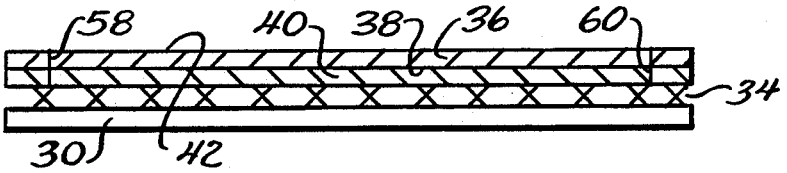
FIG. 4 is a sectional view taken approximately along the line 4—4 in FIG. 2.

Referring now to FIGS. 2–4, one individual form length will be described in greater detail. It should be observed that while FIG. 1 illustrates the form as being in continuous form, it need not be so. Forms may be made in individual form lengths or as so-called unit sets in conventional fashion and then processed through printers, such as the Xerox 9700 printer, that operate on individual sheets as opposed to continuous business forms.

The individual form length 14 illustrated in FIG. 2 is made up of parts of two webs. A first web is lowermost in FIGS. 2, 3 and 4 and is designated 30. The web 30 corresponds to the conventional label stock web utilized in pressure sensitive label forms. Because according to the instant invention this web will not necessarily serve any label purpose as will be seen, it should be understood that reference to label stock is only to indicate that the web 30 occupies the same location in a pressure sensitive label as the label stock not to connote that the web 30 need be formed of paper or the like having the relatively high quality, strength or thickness of the stock conventionally utilized as label stock in pressure sensitive labels.

As can be seen best in FIGS. 3 and 4, and to a limited degree in FIG. 2, an upper surface 32 of the web 30 is coated with pressure sensitive adhesive 34 indicated by X's in FIGS. 3 and 4 and by stippling in FIG. 2.

A second web 36 of release liner material is removably adhered to the web 30 by the adhesive 32. The web 36 has a width on the same order as the web 30 and its lower surface 38 is coated with a waxy substance 40 as is conventional so as to provide a bond between the web 38 and the adhesive 34 that allows the two to be separated with the adhesive 34 remaining on the web 30. Where the form is continuous, the web 36 will normally be somewhat wider than the web 30 and only the web 36 provided with pinfeed holes 20. This prevents the pinfeed holes 20 from becoming gummed up with the adhesive 32 which could interfere with feeding.

The surface 42 of the release liner 36 that is opposite the coating 40 and remote from the adhesive 34 is adapted to receive variable information in the areas 24 and 26 as mentioned previously and further may be provided with the preprinting 22 as earlier described.

In the preferred embodiment, the form is rectangular, having top, bottom and opposed side edges 50, 52, 54 and 56 respectively. When the form is a continuous business form, the edges 50 and 52 will be defined by severed ones of the lines of weakening 16. Similarly, the edges 54 and 56 will be defined by severing along the lines 28.

In any event, just interiorly of each of the edges 50, 52, 54 and 56 is a corresponding cut 58, 60, 62 and 64 which together define a peripheral cut. It will be apparent from FIG. 2 that the cuts 58, 60, 62 and 64 do not extend to the marginal edges, but only extend to where they intersect the adjacent one of the cuts 58, 60, 62, 64. The cuts 58, 60, 62 and 64 extend only through the web 36 and the coating 40 thereon as seen in FIGS. 3 and 4. As a consequence, a one-piece, closed frame 68, formed in the web 36, extends about the entire periphery of the form length 14. Thus, the frame 68 may be grasped and peeled from the remainder of the form leaving a rectangular pattern of the adhesive 34 exposed along the marginal edges 50, 52, 54 and 56. The peeling process has been initiated in FIG. 2 where the upper left hand corner 70 of the frame 68 has been peeled back. Note, however, that the main body of the web 36 including that part bearing the fixed information 22 and the areas 24 and 26 for receipt of variable information remains adhered to the label stock web 30.

In the usual case, the form will be manufactured as generally described and then processed to inscribe variable information in the areas 24 and 26. The frame 68 is then removed as a single piece to expose the adhesive 34 at each of the marginal edges 50, 52, 54, 56. The form may then be applied to a window by placing the surface 42 of the sheet or web 36 against the window and applying pressure to the web 30 oppositely of the exposed adhesive 34 and in the direction of the window.

Where the business form is utilized as a so-called "sticker" in new car sales, when the sale is completed and it is desired to remove the sticker thus applied to the window, it is only necessary to break the adhesion of the exposed adhesive 34 from the window. This can be initiated with a razor blade or the like at one of the corner of the web 30 until a sufficient part has been released from the window so as to be graspable when the adhesive pattern extends peripherally around the entire form. However, if the adhesive is applied only to two opposed edges, one need only slip ones hand between the window and the form applied thereto and gently peel the form from the window.

Figure 5:
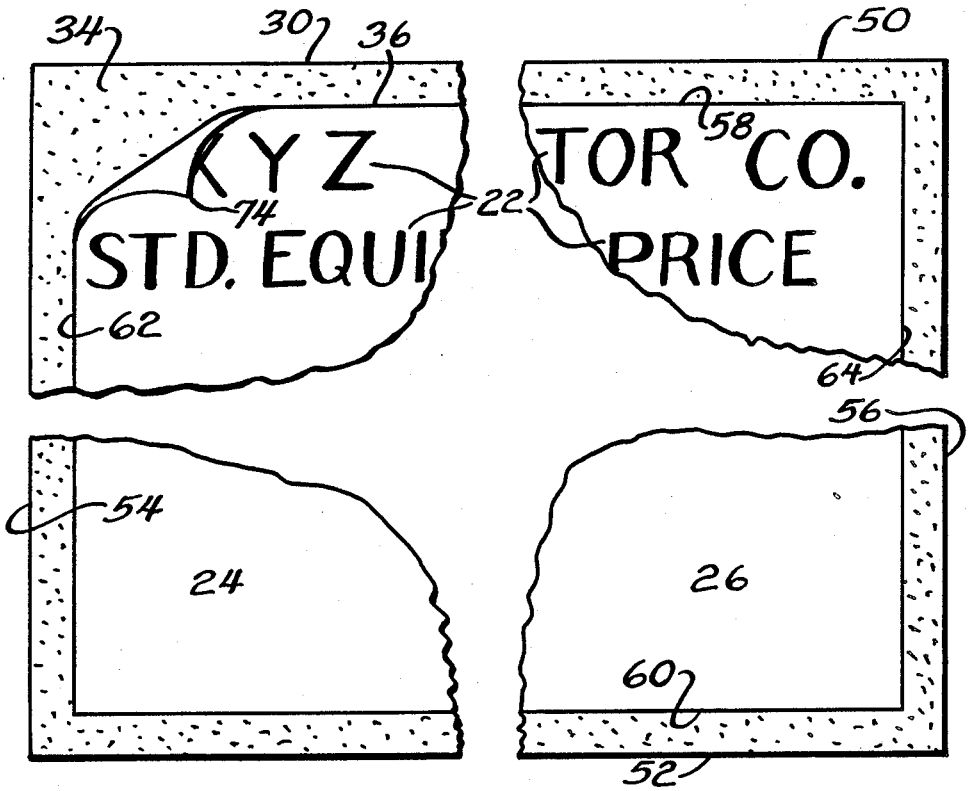
FIG. 5 is a view similar to FIG. 2 but at a subsequent stage in the processing of the business form.

In order to save the remainder of the web 36 which contains both fixed information 22 and the variable information printed at the locations 24 and 26, it is only necessary to peel the remainder of the web 36 from the web 30. FIG. 5 illustrates the initiation of the peeling process wherein the upper left hand corner 74 of the remainder of the web 36 is being peeled back.

Upon the completion of peeling, one will be left with the sheet 36, less the frame 68 and the same will be free of any of the adhesive 34. It thus may serve as a convenient record. Because only peeling is required to separate the webs 30 and 36 from each other and the web 30 from a window to which the form may be mounted, there is no destruction, distortion or mutilation involved in the removal process. Consequently, an excellent record, free of residual adhesive, that may be filed for future reference is provided.

Figure 6:
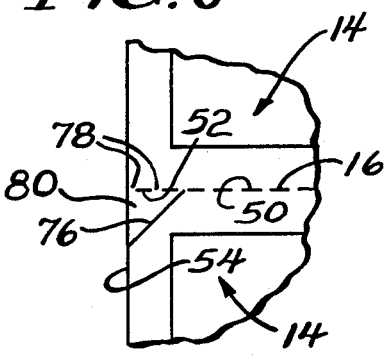
FIG. 6 is an enlarged, fragmentary view of part of the invention showing a removal tab when two forms in a continuous business form assembly have not been severed from one another.
Figure 7:
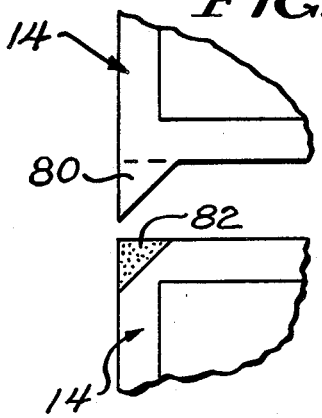
FIG. 7 is a view similar to FIG. 6 but illustrating the appearance of the components after two adjacent forms in a continuous business form have been separated from one another.

FIGS. 6 and 7 illustrate a particularly desirable feature of the invention. As seen in FIG. 6, two adjacent form lengths 14 remain in end-to-end abutment, being connected by a line of weakening 16 that is coextensive with the marginal edges 50 of the lowermost one of the forms and 52 of the uppermost form. A diagonal slit 76 extends through the second web 36 but not through the web 30 and between the line of weakening 16, that is, the marginal edges 50, 52 and the marginal edge 54. Because in the typical case, the line of weakening 16 will be a perforation, ties 78 will extend across the line of weakening 16 to connect adjacent parts of the web 36 including the triangular corner 80 that results from placing the slit 76 at the location previously described. By making the ties 78 in the area of the triangular corner 80 relatively strong, when the form is burst along the lines of weakening into individual form lengths as illustrated in FIG. 7, the triangular corner 80, though formed out of the sheet 36 of the lowermost form length 14, will remain with the uppermost form length 14. Similarly, a small triangular patch of exposed adhesive 82 on the web 30 will remain on the lowermost form 14. As a consequence, on both there is defined a removal tab to facilitate grasping of the form and the removal of the frame 68.

Where the frame is continuous and in one piece, only one of the slits 76 need be provided. However, if the frame is discontinuous or if removable sections of the sheet 36 are provided only at selected marginal edges, it may be desirable to utilize a structure as illustrated in FIGS. 6 and 7 for each such section.

From the foregoing it will be appreciated that a business form made according to the invention is ideally suited for providing displays of variable information on transparent objects such as vehicular windows and then later serving as a record of the variable information that has been displayed. The form readily facilitates both the mounting of the display piece to the window as well as its removal without partial or entire destruction or mutilation or distortion of the display piece itself.

We claim:

1. A business form for use as a removable sticker wherein a variable information receiving section may be adhered to a transparent object and then easily removed therefrom without carrying residual adhesive, said business form comprising:

a first sheet of label stock having one side coated with pressure sensitive adhesive;

a second sheet of release liner material having a size and shape corresponding to said first sheet, a coated surface removable adhered to said adhesive, and an opposed surface remote from said adhesive for receiving variable information to be displayed through a transparent object;

cuts in said second sheet near at least two opposed edges thereof so that parts of said second sheet between said opposed edges and said cuts may be removed from adhesion to said first sheet to expose adhesive at said two opposed edges in flanking relation to said opposed surface and variable information thereon, whereby said form may be adhered to a transparent object by said exposed adhesive and, when removed therefrom, the remainder of said second sheet may be peeled from said first sheet free of residual adhesive;

said cuts being opposed parts of a peripheral cut in said second sheets, said peripheral cut in the edges of said second sheet defining a removable, one-piece continuous peripheral frame; and, an exposed grasping tab on one of said sheets;

there being a plurality of said business forms in end-to-end abutment delineated from one another by lines of weakening to thereby define a continuous business form.

2. A continuous business form comprising:

a first elongated web of label stock having one side coated with a pressure sensitive adhesive;

a second elongated web of a width on the same order as said first web and made of release liner material having a coated surface removably adhered to said one side and an opposite surface adapted to receive variable information; and cross lines of weakening in said webs defining individual form lengths;

said individual form lengths having removable opposed marginal sections of said second web which may be removed to expose said adhesive in flanking relation to variable information on said opposite surface.

3. The continuous business form of claim 2 wherein the second web of each form length includes a slit extending from one marginal edge to an adjacent marginal edge across at least one said section to define a removal tab to facilitate removal of said one section.

4. The continuous business form of claim 2 wherein said marginal edges are defined by said lines of weakening.

5. The continuous business form of claim 2 wherein said marginal edges are the longitudinal edges of said webs.

6. The continuous business form of claim 2 wherein said marginal edges are both the lines of weakening and the longitudinal edges of said webs.

7. The continuous business form of claim 6 wherein said sections make up a removable one piece frame about the periphery of each said form length.

* * * * *